US011079096B2

(12) United States Patent
Ninomiya et al.

(10) Patent No.: US 11,079,096 B2
(45) Date of Patent: Aug. 3, 2021

(54) LIGHTING FIXTURE AND LIGHTING APPARATUS

(71) Applicant: NICHIA CORPORATION, Tokushima (JP)

(72) Inventors: Susumu Ninomiya, Gosen (JP); Tetsutoshi Ishida, Niigata (JP)

(73) Assignee: Nichia Corporation, Anan (JP)

( * ) Notice: Subject to any disclaimer, the term of this patent is extended or adjusted under 35 U.S.C. 154(b) by 89 days.

(21) Appl. No.: 16/427,904

(22) Filed: May 31, 2019

(65) Prior Publication Data

US 2019/0368697 A1 Dec. 5, 2019

(30) Foreign Application Priority Data

May 31, 2018 (JP) ..... JP2018-105317
May 17, 2019 (JP) ..... JP2019-093656

(51) Int. Cl.

| | |
|---|---|
| ***F21V 21/03*** | (2006.01) |
| ***F21V 3/02*** | (2006.01) |
| ***F21Y 115/10*** | (2016.01) |
| ***F21Y 105/10*** | (2016.01) |

(52) U.S. Cl.

CPC ..... *F21V 21/03* (2013.01); *F21V 3/02* (2013.01); *F21Y 2105/10* (2016.08); *F21Y 2115/10* (2016.08)

(58) Field of Classification Search

CPC .. G02B 6/0078; G02B 6/0046; G02B 6/0048; G02B 6/0061; F21V 21/03; F21V 3/02; F21S 8/046; F21Y 2105/10; F21Y 2115/10

See application file for complete search history.

(56) References Cited

U.S. PATENT DOCUMENTS

2014/0362602 A1* 12/2014 Hofman ..... E04B 2/7863 362/612
2017/0090103 A1* 3/2017 Holman ..... G02B 6/003
2020/0041106 A1* 2/2020 Ninomiya ..... F21V 21/03

FOREIGN PATENT DOCUMENTS

CN 103322448 A * 9/2013 ..... F21S 2/00
JP H08-321211 A 12/1996
JP H11-203925 A 7/1999
JP 2007-323857 A 12/2007
JP 2008-282743 A 11/2008
JP 2011-508373 A 3/2011
JP 2012-248308 A 12/2012
JP 2013-134956 A 7/2013

(Continued)

*Primary Examiner* — Mary Ellen Bowman
(74) *Attorney, Agent, or Firm* — White & Case LLP

(57) ABSTRACT

A lighting fixture includes a light source module having a base with a surface having first and second lateral edges, and a plurality of light sources disposed on the surface of the base. A cover disposed over the light source module includes a light-transmissive main surface terminating at third and fourth lateral edges. A first light-transmissive side surface extends from the third lateral edge towards the first lateral edge, and a second light-transmissive side surface extends from the fourth lateral edge towards the second lateral edge. The first lateral edge is laterally offset by a first distance from a first orthogonal reference plane with respect to the third lateral edge, and the second lateral edge is laterally offset by a second distance from a second orthogonal reference plane with respect to the fourth lateral edge.

21 Claims, 13 Drawing Sheets

(56) References Cited

FOREIGN PATENT DOCUMENTS

| | | | | |
|---|---|---|---|---|
| JP | 2014-135151 | A | 7/2014 | |
| JP | 2015-22932 | A | 2/2015 | |
| JP | 2015-32467 | A | 2/2015 | |
| JP | 2016-21296 | A | 2/2016 | |
| JP | 2016-54122 | A | 4/2016 | |
| JP | 6063926 | B2 | 1/2017 | |
| WO | 2009-078007 | A2 | 6/2009 | |
| WO | WO-2015102094 | A1 * | 7/2015 | ..... F21S 8/04 |

* cited by examiner

LIGHTING FIXTURE AND LIGHTING APPARATUS

CROSS-REFERENCE TO RELATED APPLICATIONS

The present application claims priority to Japanese Patent Application No. 2018-105317, filed May 31, 2018, and Japanese Patent Application No. 2019-093656, filed on May 17, 2019, the contents of which are incorporated herein in their entirety.

BACKGROUND OF THE INVENTION

Field of the Invention

The present invention relates to a lighting fixture and a lighting apparatus.

Background

Multiple flat lighting fixtures arrayed adjacent to one another on a ceiling or a wall provide a large emitting surface. In such a case, the lighting fixtures may be tightly arranged without a gap between adjacent fixtures, or may be arranged with a gap between adjacent lighting fixtures. However, arranging the lighting fixtures with a gap between adjacent lighting fixtures may generate dim areas at boundaries of the adjacent lighting fixtures. Further, arranging the lighting fixtures with a gap between adjacent fixtures may expose the wall, ceiling, or base of the lighting fixture which, in addition to creating dim regions, is not aesthetically pleasing.

Patent document 1: WO2009/078007

Patent document 2: Japanese Patent No. 6063926

Based on the foregoing, there is a current need for a lighting apparatus having lighting fixtures arranged with a gap between adjacent lighting fixtures that does not generate dim areas at the boundaries of the lighting fixtures.

SUMMARY OF THE INVENTION

In an aspect, a lighting fixture includes a light source module including a base having a surface with a first lateral edge and a second lateral edge, and a plurality of light sources disposed on the surface of the base. The lighting fixture also includes a light-transmissive cover disposed over the light source module, the light-transmissive cover including a main surface separated from the surface of the base, the main surface terminating at a third lateral edge and a fourth lateral edge, a first side surface extending from the third lateral edge towards the first lateral edge of the base and a second side surface extending from the fourth lateral edge towards the second lateral edge of the base. the first lateral edge is laterally offset by a first distance from a first orthogonal reference plane with respect to the third lateral edge, the second lateral edge is laterally offset by a second distance from a second orthogonal reference plane with respect to the fourth lateral edge, and the main surface, first side surface, and the second side surface are formed from a light-transmissive material configured to transmit light emitted by the plurality of light sources.

DETAILED DESCRIPTION OF THE INVENTION

Figure 1:
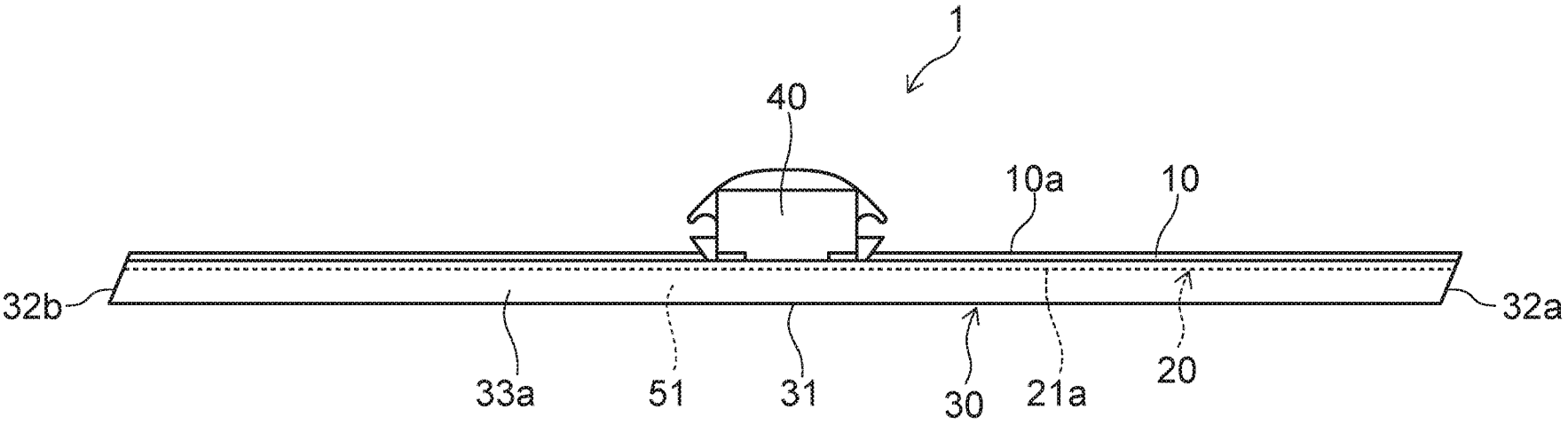
FIG. 1 shows a schematic longitudinal side view of a lighting fixture according to an embodiment.

Embodiments of the present invention will be described below with reference to the accompanying drawings. In the drawings, the same reference numeral generally represents the same member.

As used herein, the term side surfaces is interchangeable with lateral inclined surfaces or lateral surfaces. The term base is used interchangeably with substrate or base substrate. The term main surface is used interchangeably with main emitting surface or main light emitting surface.

FIG. 1 shows a schematic longitudinal side view of a lighting fixture 1 according to an embodiment.

Figure 2:
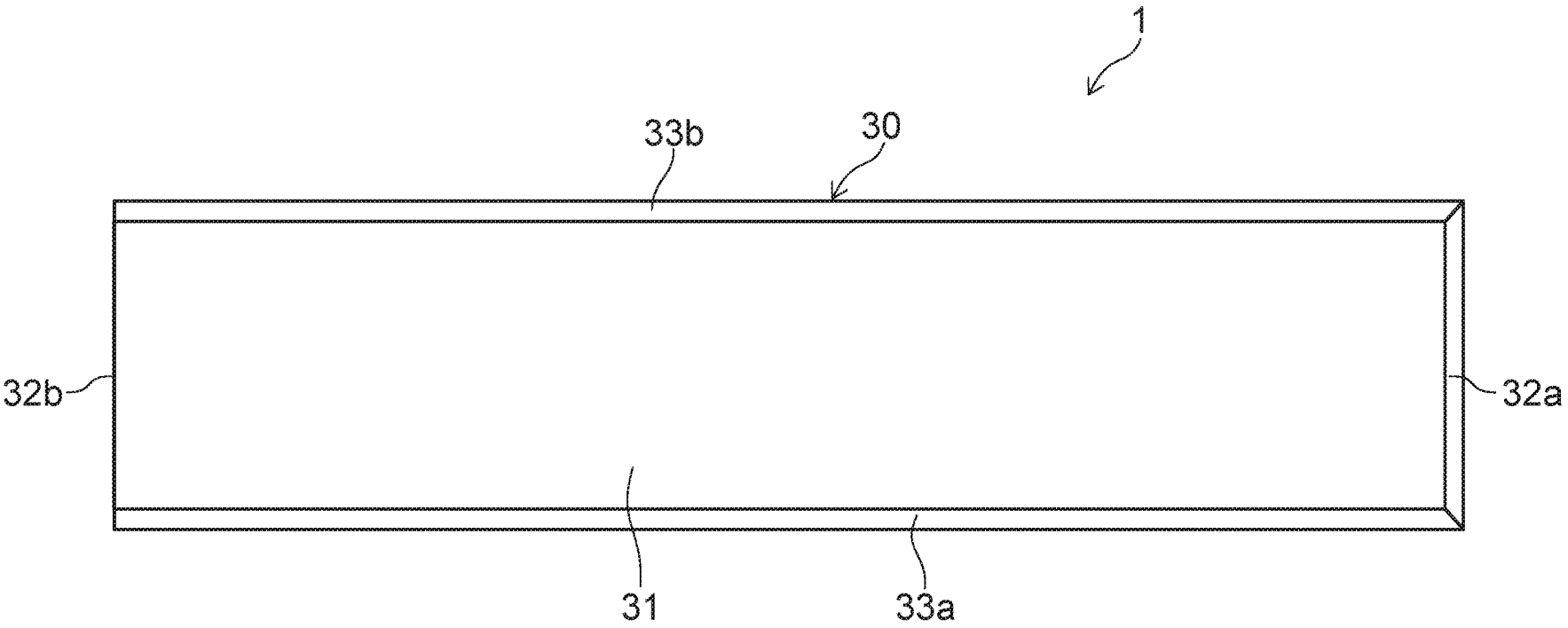
FIG. 2 shows a schematic front view of the lighting fixture according to the embodiment.

FIG. 2 shows a schematic front view of the lighting fixture 1 according to the embodiment.

Figure 3:
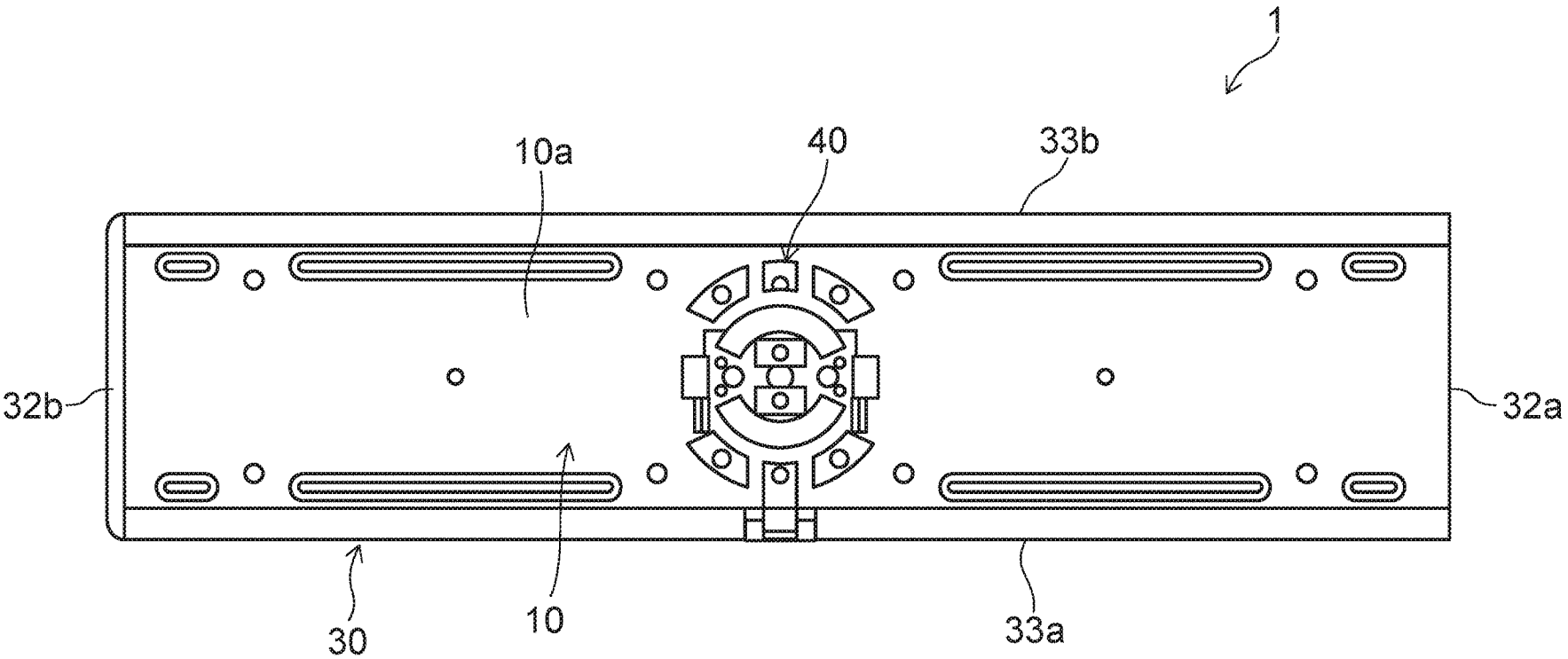
FIG. 3 shows a schematic rear view of the lighting fixture according to the embodiment.

FIG. 3 shows a schematic rear view of the lighting fixture 1 according to the embodiment.

Figure 4:
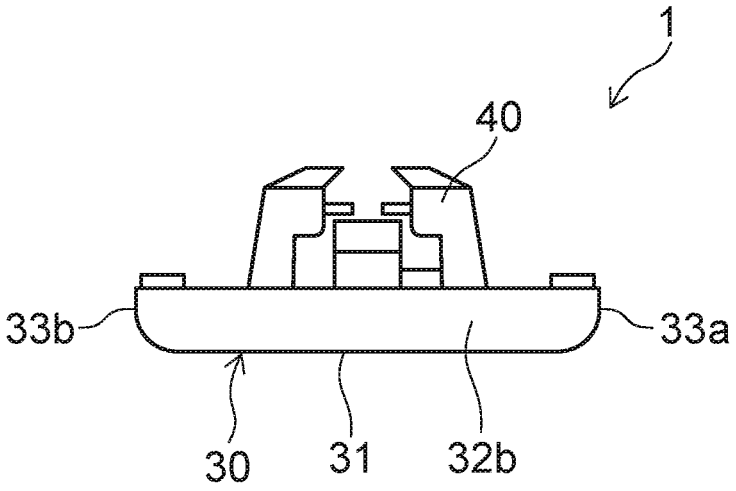
FIG. 4 shows a schematic transverse side view of the lighting fixture according to the embodiment.

FIG. 4 shows a schematic transverse side view of the lighting fixture 1 according to the embodiment.

Figure 5:
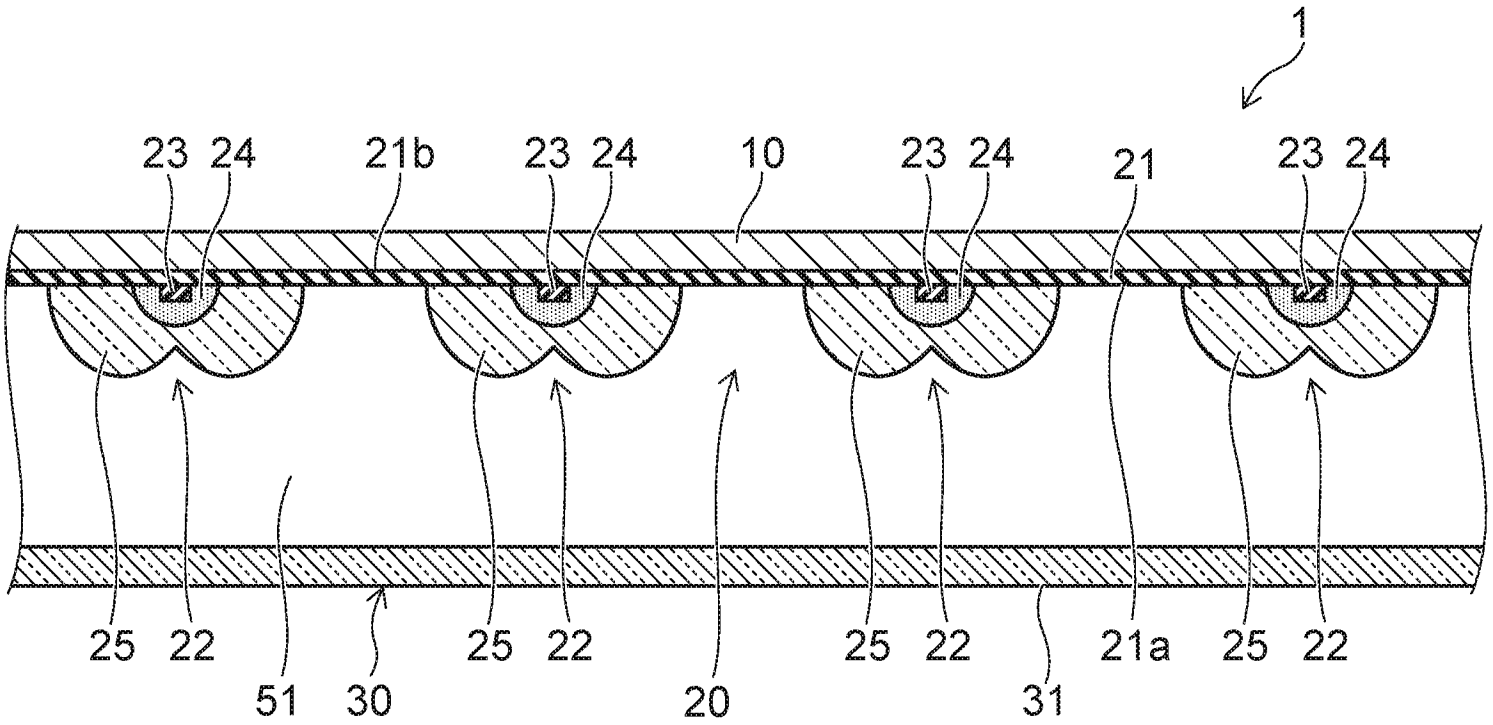
FIG. 5 shows a schematic sectional view of the lighting fixture according to the embodiment.

FIG. 5 shows a schematic sectional view of the lighting fixture 1 according to the embodiment.

Figure 6:
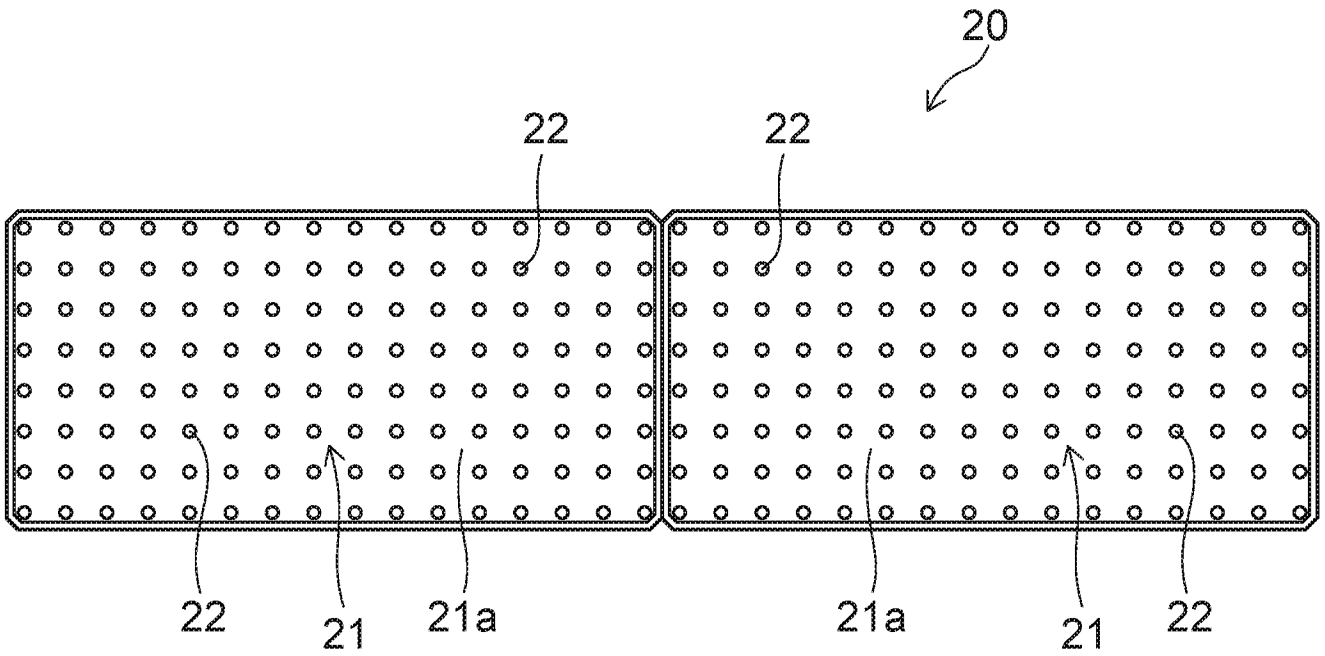
FIG. 6 shows a schematic plan view of a light source module of the lighting fixture according to the embodiment.

FIG. 6 shows a schematic plan view of a light source module 20 of the lighting fixture 1 according to the embodiment.

A lighting fixture 1 has a base plate 10, a light source module 20, a cover 30, and a mounting adaptor 40.

The light source module 20 is mounted on a surface of the base plate 10. The cover 30 is attached to the base plate 10 so as to cover the light source module 20.

The base plate 10 functions as a reinforcing plate and a heat sink of the light source module 20. The base plate 10 is, for example, a metal plate formed into a rectangular shape. The base plate 10 may alternatively be any suitable shape.

As shown in FIGS. 5 and 6, the light source module 20 has a base (also referred to herein as a substrate) 21 and multiple light sources 22. The base 21 has a light source placement surface 21*a* and a rear surface 21*b* opposite to the light source placement surface 21*a*. The light sources 22 are periodically arrayed on the light source placement surface 21*a* of the base 21. In an example shown in FIG. 6, the light sources 22 are arrayed in a lattice pattern at an equal pitch.

The base 21 is an insulating substrate made of, for example, resin or ceramic. The base 21 has an electrical conductor pattern on the light source placement surface 21*a*. As shown in FIG. 5, each of the light sources 22 includes, for example, a light-emitting element 23 such as light emitting diode (LED), a phosphor layer 24, and a resin member 25. The light-emitting element 23 is mounted on the light source placement surface 21*a* of the base 21. Electrodes of the light-emitting element 23 are electrically connected to the conductor pattern on the base 21.

The phosphor layer 24 covers the light-emitting element 23. The resin member 25 covers the phosphor layer 24. The resin member 25 has a depressed portion that covers around a center of an upper surface of the light-emitting element 23. This shape allows the resin member 25 to function as a lens that provides a batwing light distribution characteristic to the light source 22.

Figure 7:
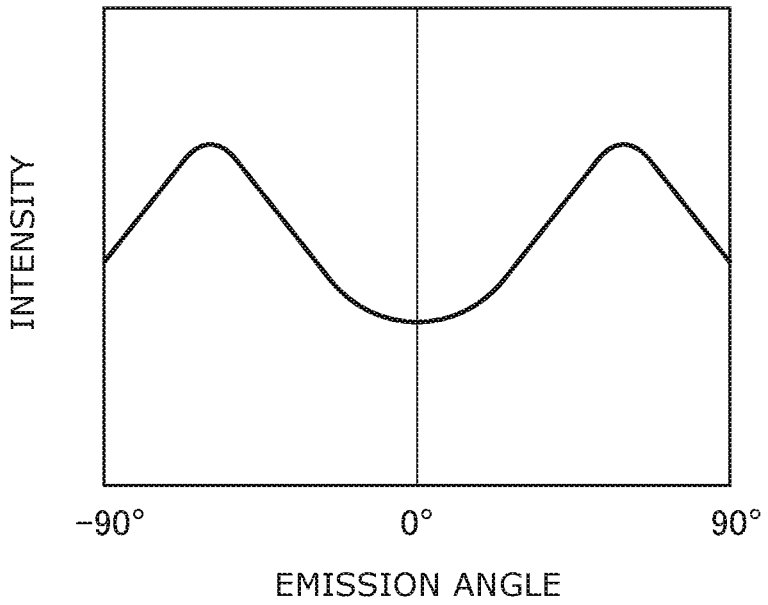
FIG. 7 shows a graph illustrating a light distribution characteristic of a light source of the lighting fixture according to the embodiment.

FIG. 7 shows an example illustrating a batwing light distribution characteristic. The horizontal axis represents an emission angle of light emitted from the light source 22. The emission angle is zero degrees at a direction vertical to the light source placement surface on which the light source 22 is arranged. The vertical axis represents intensity of light emitted from the light source 22.

The term "batwing light distribution characteristic" means the light distribution characteristic exhibiting a first peak in a range of emission angles from zero degrees to −90 degrees and a second peak in a range of emission angles from zero degrees to 90 degrees, the first peak and the second peak each having an intensity higher than an intensity at the emission angle of zero degrees.

The base 21 of the light source module 20 is mounted on the base plate 10 by, for example, screws or any other suitable fastener. The rear surface 21*b* of the base 21 is in contact with the base plate 10. In an example shown in FIG. 6, two bases 21 of light source modules 20 are arrayed along the longitudinal direction of the base plate 10 having a rectangular shape. Hence, in this example embodiment, the light source module 20 has a rectangular planer shape.

The cover 30 is transmissive for light emitted from the light source 22. The cover 30 is formed from, for example, a resin material with a light diffusing substance such as titanium oxides dispersed in the resin material to exhibit a milk white color having light diffusing property.

As shown in FIGS. 1 and 2, the cover 30 has a main surface 31 and four lateral surfaces 32*a*, 32*b*, 33*a*, and 33*b*. The two lateral surfaces 32*a* and 32*b* (also referred to herein as side surfaces or lateral inclined surfaces) out of the four lateral surfaces are each formed as an inclined lateral surface to be described later. In an embodiment, the main surface 31 has a rectangular shape that matches the planar shape of the light source module 20. In other embodiments, the main surface 31 and the light source module 20 may be formed to have other non-rectangular shapes. The lateral surfaces 32*a*, 32*b*, 33*a*, and 33*b* are integrally formed on the four sides (or end portions) of the main surface 31. Each of the lateral surfaces 32*a*, 32*b*, 33*a*, and 33*b* protrudes from the main surface 31 toward the base plate 10.

The main surface 31 has a rear surface that faces the light source placement surface 21*a* across a space 51 as shown in FIG. 5, with the cover 30 attached to the base plate 10. That is, the space 51 is formed between the rear surface of the main surface 31 and the light source placement surface 21*a*. The four lateral surfaces 32*a*, 32*b*, 33*a*, and 33*b* of the cover 30 surround the periphery of the space 51.

As shown in FIG. 2, the four lateral surfaces 32*a*, 32*b*, 33*a*, and 33*b* are arranged such that a pair of inclined lateral surfaces 32*a* and 32*b* are formed at both end portions in the longitudinal direction of the main surface 31 and a pair of lateral surfaces 33*a* and 33*b* are formed at both end portions in the transverse direction of the main surface 31. The inclined lateral surfaces 32*a* and 32*b* extend along the transverse direction of the main surface 31 and the lateral surfaces 33*a* and 33*b* extend along the longitudinal direction of the main surface 31.

As shown in FIG. 1, the inclined lateral surfaces 32*a* and 32*b* are inclined relative to the main surface 31. In the example shown in FIG. 1, the inclined lateral surface 32*a*, which is one of the pair of inclined lateral surfaces 32*a* and 32*b*, forms an obtuse angle relative to the main surface 31 and an acute angle relative to the light source placement surface 21*a*. The inclined lateral surface 32*b*, which is the other of the pair of inclined lateral surfaces 32*a* and 32*b*, forms an acute angle relative to the main surface 31, and an obtuse angle relative to the light source placement surface 21*a*.

A whole area of a lateral surface at each end portion in the longitudinal direction of the cover 30 constitutes the inclined lateral surface 32*a* that forms the obtuse angle relative to the main surface 31 or the inclined lateral surface 32*b* that forms the acute angle relative to the main surface 31. Alternatively, the lateral surface at the end portion in the longitudinal direction of the cover 30 may include a surface or a step other than the inclined lateral surfaces 32*a* or 32*b*, such as a curved surface. Even in such a case, most of the area of the lateral surface at the end portion in the longitudinal direction of the cover 30 is preferably constituted by the inclined lateral surface 32*a* or the inclined lateral surface 32*b*.

In the base plate 10, a back surface 10*a* is opposite to the surface on which the light source module 20 is mounted and serves as a mounting surface used to mount the lighting fixture 1 to a wall or a ceiling. As shown in FIGS. 1 and 3, the back surface 10*a* of the base plate has the mounting adaptor 40.

The lighting fixture 1 is mounted to the wall or the ceiling by, for example, fitting the mounting adaptor 40 to a power adaptor embedded in the wall or the ceiling, or to a mounting hardware. In one example, the lighting fixture 1 is mounted to a ceiling, and the main surface 31 of the cover 30 is substantially parallel to a ceiling surface and is directed toward a space below the ceiling. In another example, the lighting fixture 1 is mounted on a wall, and the main surface 31 of the cover 30 is substantially parallel to a wall surface and is directed toward a lateral space of the wall.

Light emitted from the light source 22 propagates the space 51 between the light source module 20 and the cover 30 and is extracted outside the lighting fixture 1 from the main surface 31 and the four lateral surfaces 32*a*, 32*b*, 33*a*, and 33*b* of the cover 30. The main surface 31 has an area larger than a total area of the four lateral surfaces 32*a*, 32*b*, 33*a*, and 33*b*. This configuration allows the light emitted from the main surface 31 to mainly illuminate the space below the ceiling or the lateral space of the wall. The light emitted from each of the lateral surfaces 32*a*, 32*b*, 33*a*, and 33*b* illuminates the ceiling surface or the wall surface, which provides indirect illumination, decreasing the appearance of dim areas at the boundaries of the light fixture and reducing the visibility of the wall or base plate 10 around the light fixture.

Even in the case where a short distance is provided between the light source 22 and the main surface 31 of the cover 30, as the lighting fixture is made thinner, the main surface 31 serves as an emitting surface with reduced unevenness in luminance. The main surface 31 instead has uniform luminance because the light source 22 has a batwing light distribution characteristic, as described above with regard to FIG. 7. The batwing light distribution characteristic prevents a person from being dazzled by a point-like view of the light source 22 when the main surface 31 enters a field of view of the person.

Multiple lighting fixtures 1 arrayed side by side on the wall or the ceiling can constitute a lighting apparatus having a larger emitting surface.

Figure 8A:
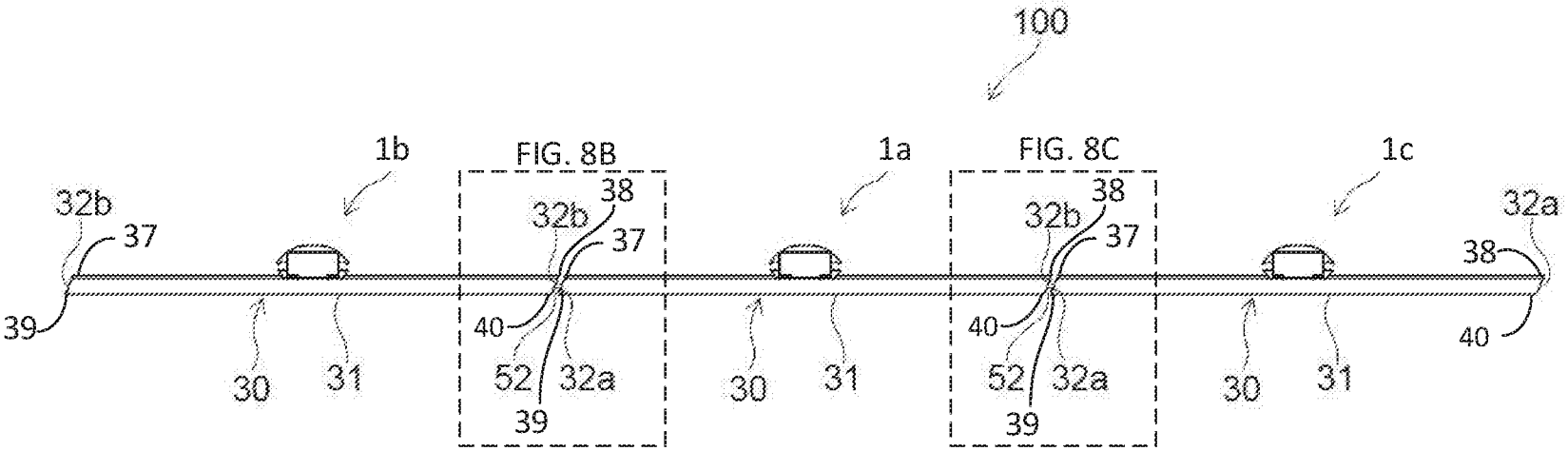
FIG. 8A shows a schematic side view of a lighting apparatus including three lighting fixtures according to another embodiment.
Figure 8B:
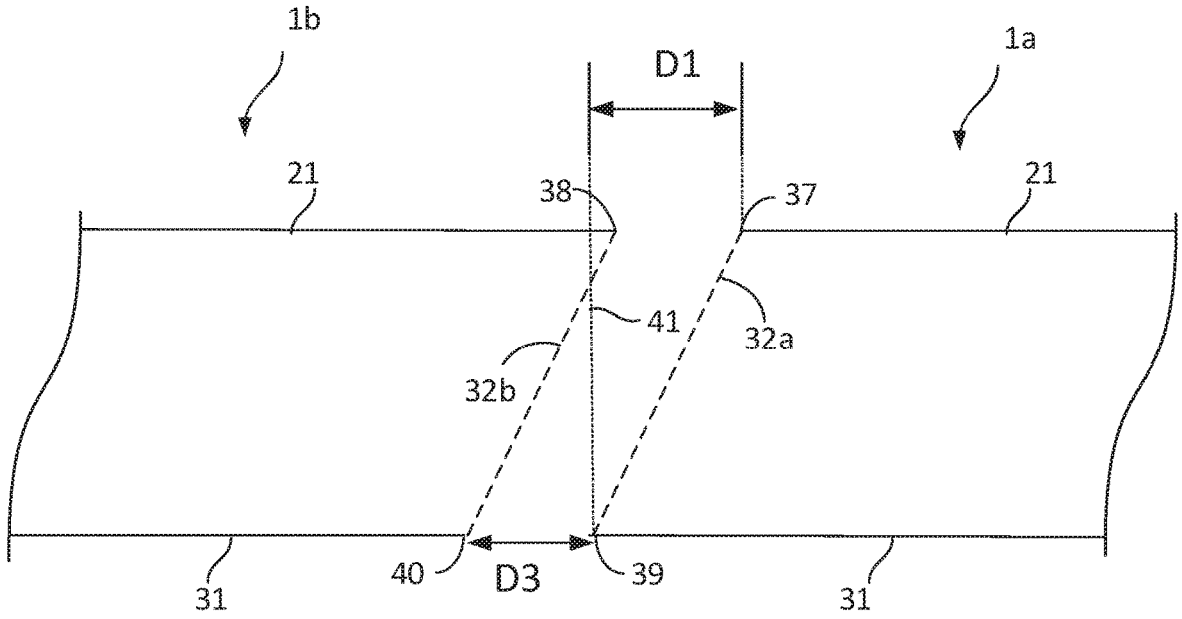
FIG. 8B shows a schematic enlarged view of the boundary between the first and second lighting fixtures of FIG. 8A.
Figure 8C:
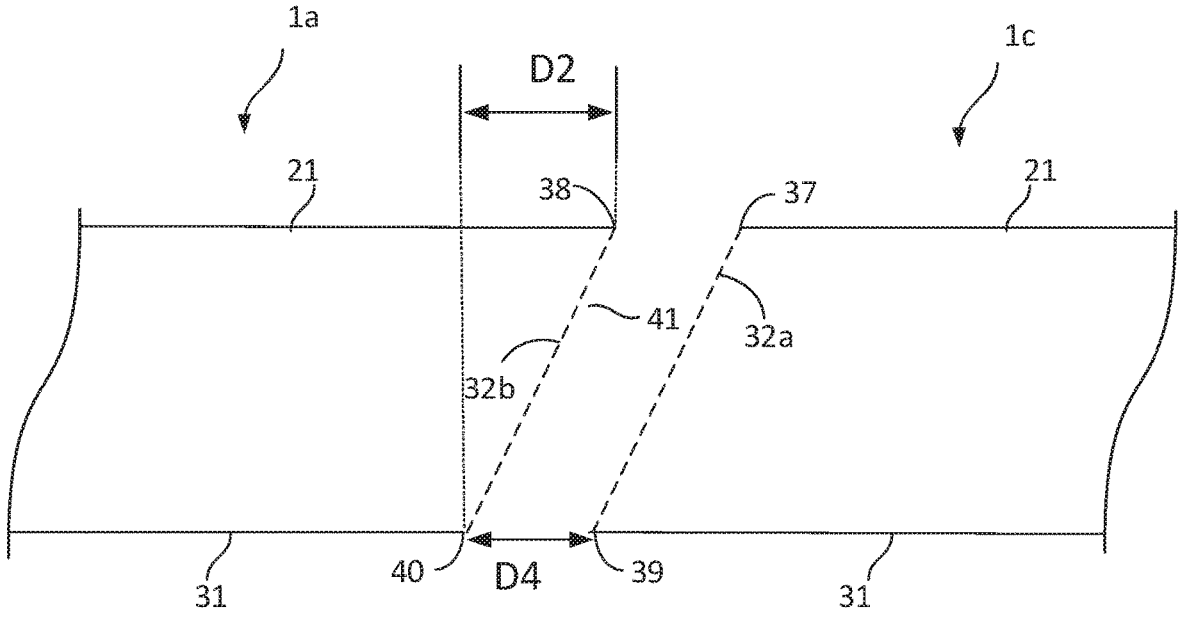
FIG. 8C shows a schematic enlarged view of the boundary between the first and third lighting fixtures of FIG. 8A.

FIG. 8A shows a schematic side view of a lighting apparatus 100 including three lighting fixtures according to another embodiment, FIG. 8B shows a schematic side view of the boundary between the first and second lighting fixtures shown in FIG. 8A, and FIG. 8C shows a schematic side view of the boundary between the first and third lighting fixtures shown in FIG. 8A.

Figure 9:
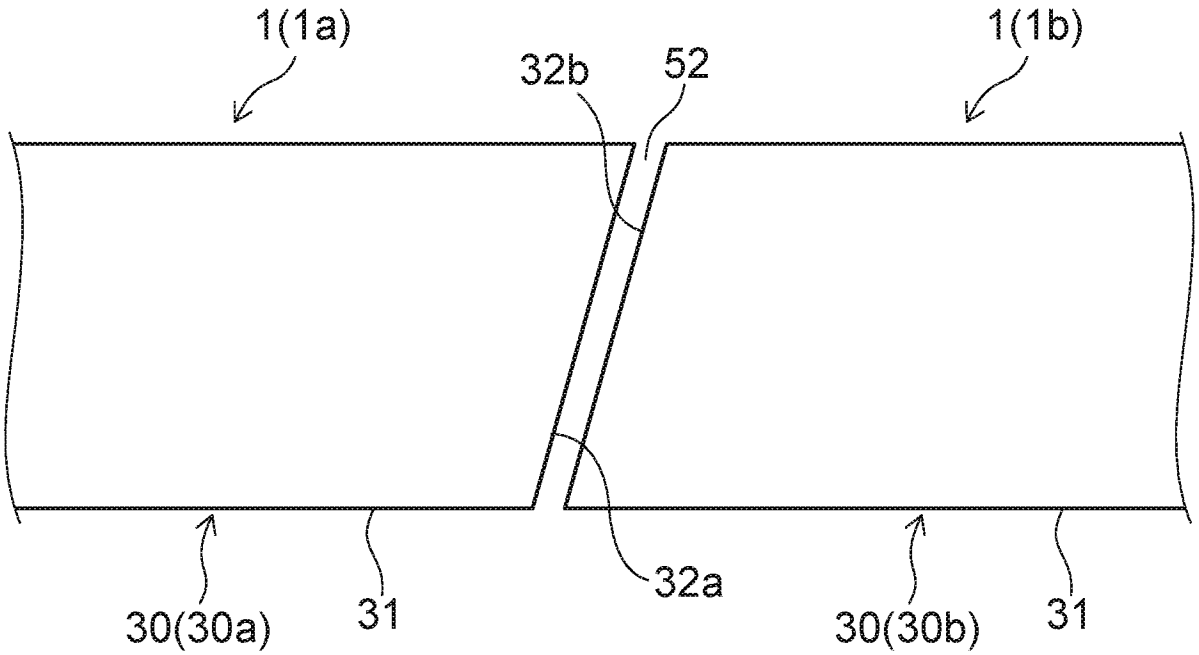
FIG. 9 shows a schematic enlarged view at a boundary portion between covers of adjacent lighting fixtures shown in FIG. 8A.

FIG. 9 shows a schematic enlarged view of the lighting apparatus 100 shown in FIG. 8 illustrating a generic boundary portion between a cover 30*a* of a first lighting fixture 1*a* and a cover 30*b* of a second lighting fixture 1*b* that is adjacent to the first lighting fixture 1*a*.

Figure 10:
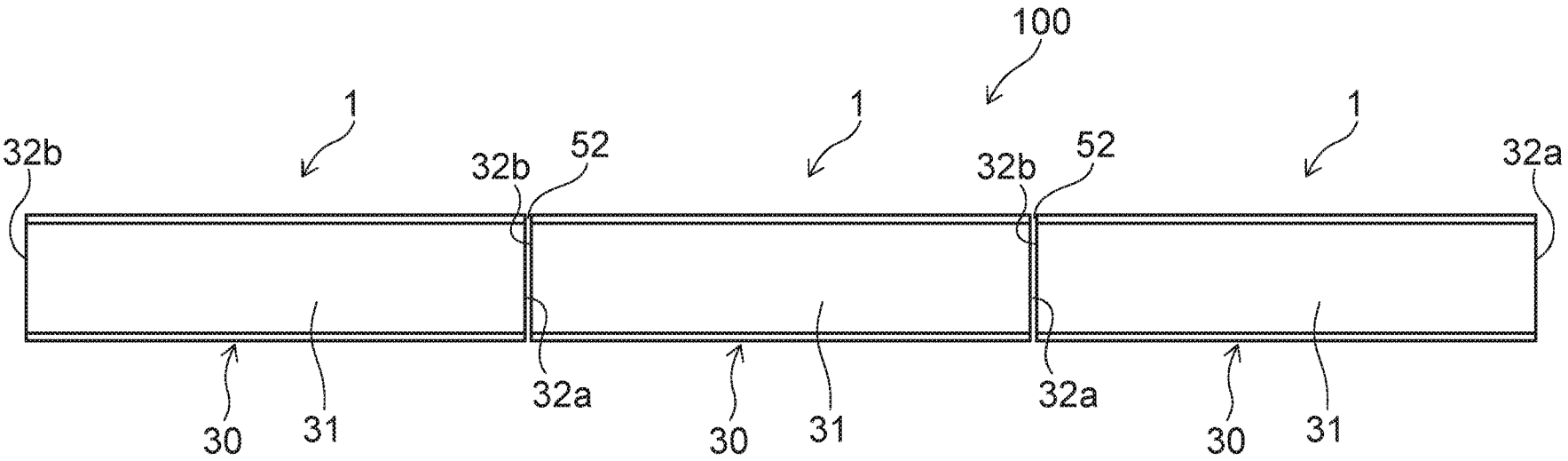
FIG. 10 shows a schematic front view of the lighting apparatus according to the other embodiment.

FIG. 10 shows a schematic front view of the lighting apparatus 100 according to the other embodiment.

Figure 11:
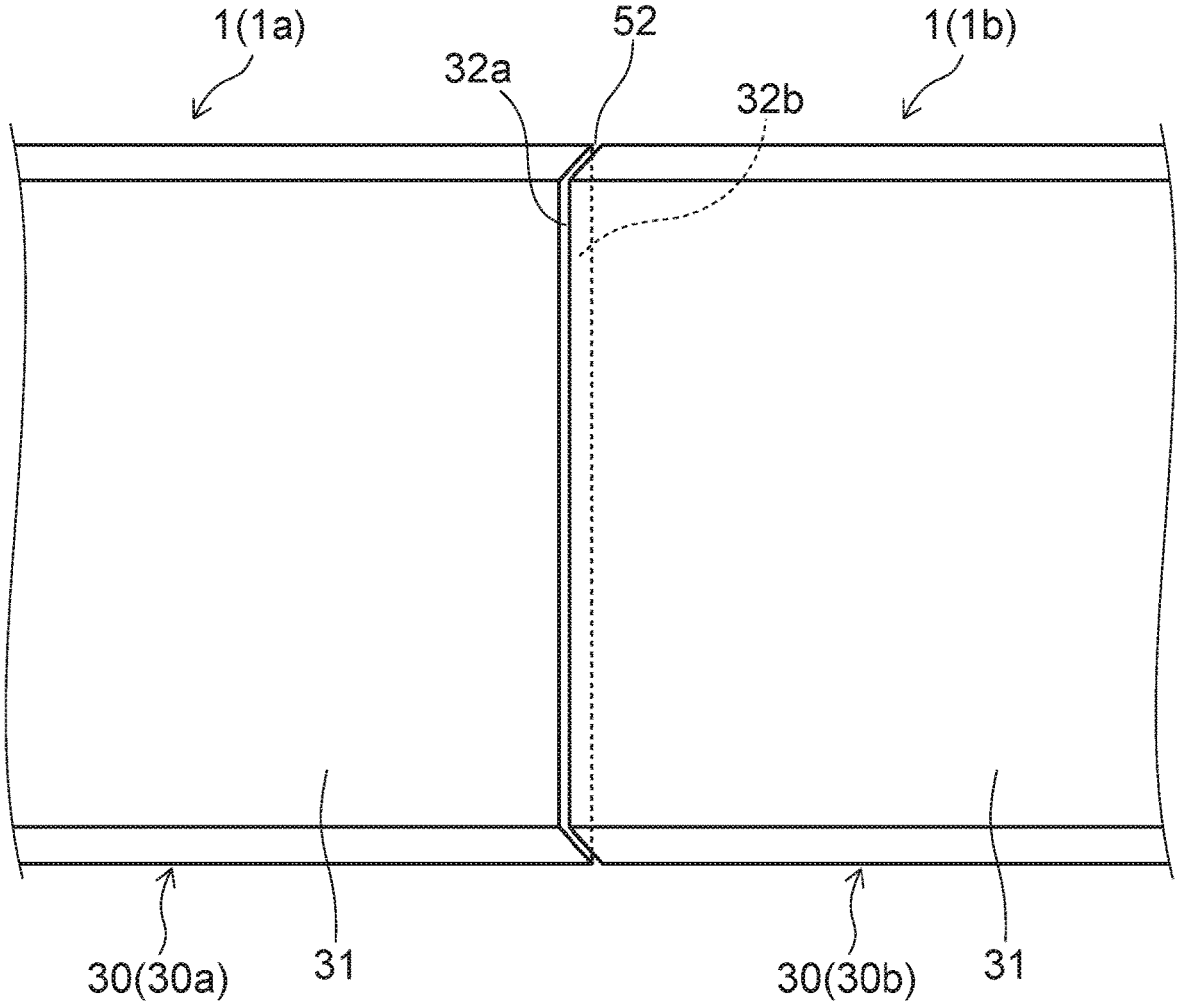
FIG. 11 shows a schematic enlarged view at a boundary portion between covers of adjacent lighting fixtures shown in FIG. 10.

FIG. 11 shows a schematic enlarged view of the lighting apparatus 100 shown in FIG. 10 illustrating the boundary portion between the cover 30*a* of the first lighting fixture 1*a* and the cover 30*b* of the second lighting fixture 1*b* that is adjacent to the first lighting fixture 1*a*.

In the example shown in FIGS. 8 and 10, three lighting fixtures are arrayed along the longitudinal direction of the lighting fixtures. First lighting fixture 1*a*, second lighting fixture 1*b*, and third lighting fixture 1*c* are arranged next to each other with a longitudinal gap in between each of the fixtures.

FIGS. 8A-C show the arrangement of adjacent lighting fixtures including first lighting fixture 1*a*, second lighting fixture 1*b*, and third lighting fixture 1*c*. Each lighting fixture includes a light source module 20 having base 21 having a first lateral edge 37 and second lateral edge 38 arranged opposite the first lateral edge 37, and a plurality of light sources (not shown for clarity, the plurality of light sources may be light sources 22 as illustrated in FIG. 1) on the surface of the base 21. The light source module including the base 21 and plurality of light sources are illustrated in FIG. 1, for example. Each lighting fixture also includes a light-transmissive cover 30 which is disposed over the light source module 20 and includes a main surface 31_separated from the surface of the base 21 and terminating at a third lateral edge 39 and a fourth lateral edge 40, a first side surface 32*a* that extends from the third lateral edge 39 towards the first lateral edge 37, and a second side surface 32*b* that extends from the fourth lateral edge 40 towards the second lateral edge 38 of the base 21.

As illustrated in FIGS. 8A-C, the first lateral edge 37 is laterally offset by a first distance (D1) from a first orthogonal reference plane 41 with respect to the third lateral edge 39, and the second lateral edge 38 is laterally offset by a second distance (D2) from a second orthogonal reference plane 42 with respect to the fourth lateral edge 40. The main surface 31, first side surface 32*a*, and second side surface 32*b* are all formed from a light-transmissive material that allows the surfaces to transmit light emitted by the plurality of sources 22. The arrangement of the main surface 31, first side surface 32*a*, and second side surface 32*b* of each of the first lighting fixture 1*a*, second lighting fixture 1*b*, and third lighting fixture 1*c* prevents the appearance of dim areas between the lighting fixtures, and also obscures the wall, ceiling, or base between the lighting fixtures from view.

FIG. 8B shows the adjacent edges of the first lighting fixture 1*a* and second lighting fixture 1*b*. The first lateral edge 37 of the base 21 of the first lighting fixture 1*a* is offset by a first distance D1 from an orthogonal plane 41 to the third lateral edge 39 of the main surface 31 of the cover 30 of the first lighting fixture 1*a*. First side surface 32*a* of the first lighting fixture 1*a* is formed as an inclined plane extending from the third lateral edge 39 of the main surface 31 to the first lateral edge 37 of the base 21. The second side surface 32*b* of the second lighting fixture 1*b* is also formed as an inclined plane extending from the fourth lateral edge 40 of the main surface 31 of the second lighting fixture 1*b* to the second lateral edge 38 of the base 21 of the second lighting fixture 1*b*. The second side surface 32*b* of the second lighting fixture 1*b* is parallel to the adjacent first side surface 32*a* of the first lighting fixture 1*a*. Further, the first distance D1 by which the first lateral edge 37 of the first lighting fixture 1*a* is offset from the third lateral edge 39 is greater than a third distance D3 measured between the main surfaces 31 of the first lighting fixture 1*a* and the second lighting fixture 1*b*. This distance D3 is equivalent to the gap between the two lighting fixtures.

FIG. 8C shows the adjacent edges of the first lighting fixture 1*a* and the third lighting fixture 1*c*. The second lateral edge 38 of the base 21 of the first lighting fixture 1*a* is offset by a second distance D2 from an orthogonal plane 41 to the fourth lateral edge 40 of the main surface 31 of the cover 30 of the first lighting fixture 1*a*. Second side surface 32*b* of the first lighting fixture 1*a* is formed as an inclined plane extending from the fourth lateral edge 40 of the main surface 31 to the second lateral edge 38 of the base 21. The first side surface 32*a* of the third lighting fixture 1*c* is also formed as an inclined plane extending from the third lateral edge 39 of the main surface 31 of the third lighting fixture 1*c* to the first lateral edge 37 of the base 21 of the third lighting fixture 1*c*. The first side surface 32*a* of the third lighting fixture 1*c* is parallel to the adjacent second side surface 32*b* of the first lighting fixture 1*a*. Further, the second distance D2 by which the second lateral edge 38 of the first lighting fixture 1*a* is offset from the fourth lateral edge 40 is greater than a fourth distance D4 measured between the main surfaces 31 of the first lighting fixture 1*a* and the third lighting fixture 1*c*. This distance D4 is equivalent to the gap between the two lighting fixtures.

Accordingly, because the first distance D1 is greater than the third distance D3 measuring the gap between the first and second lighting fixtures (as shown in FIG. 8B) and the second distance D2 is greater than the fourth distance D4 measuring the gap between the first and third lighting fixtures (as shown in FIG. 8C), the ceiling or wall to which the fixtures are attached is not visible from the direction of the main surface 31, and dim regions are eliminated between the lighting fixtures.

The first side surface 32*a* and the second side surface 32*b* of the first lighting fixture 1*a* in FIGS. 8A-C are shown as inclined planes. The inclined planes of the first side surface 32*a* and the second side surface 32*b* may be formed as shown, where the first side surface 32*a* forms an obtuse angle with respect to the base 21 and an acute angle with respect to the main surface 31, and the second side surface 32*b* forms an acute angle with respect to the base 21 and an obtuse angle with respect to the main surface 31. In some embodiments, the first side surface 32*a* and the second side surface 32*b* of the first lighting fixture may be parallel as shown. In other embodiments, the first side surface 32*a* and the second side surface 32*b* of the first lighting fixture may form different angles with respect to the base 21 such that the first side surface 32*a* is not parallel to the second side surface 32*b*. In some embodiments, the first side surface 32*a* and second side surface 32*b* of the first lighting fixture may be formed as a step or as a curved surface.

Two adjacent lighting fixtures 1 out of the three lighting fixtures 1*a*, 1*b*, and 1*c* are selected and denoted as the first lighting fixture 1*a* and the second lighting fixture 1*b* in FIGS. 9 and 11 which generically illustrate the boundaries between the lighting fixtures.

In FIGS. 9 and 11, the cover 30*a* of the first lighting fixture 1*a* has an inclined lateral surface 32*a* at one end portion and an inclined lateral surface 32*b* at the other end portion in the longitudinal direction. The cover 30*b* of the second lighting fixture 1*b* has an inclined lateral surface 32*a* at one end portion and an inclined lateral surface 32*b* at the other end portion in the longitudinal direction.

The inclined lateral surface 32*a* at one end portion of the cover 30*a* of the first lighting fixture 1*a* and the inclined lateral surface 32*b* at the other end portion of the cover 30*b* of the second lighting fixture 1*b* face each other with a gap 52. As shown in the front view of the main surface 31 in FIG. 11, the inclined lateral surfaces 32*a* and 32*b*, which face each other at the boundary portion between the first lighting fixture 1*a* and the second lighting fixture 1*b*, overlap when viewed from the main surface 31. When the main surface 31 is viewed from the front, an opening of the gap 52 at the main surface 31 does not overlap with an opening of the gap 52 at a rear side of the main surface 31.

The gap 52 between the covers 30 of the adjacent lighting fixtures 1*a* and 1*b* can absorb a precision error of a pitch between holes or adaptors for mounting the lighting fixtures to the ceiling or the wall.

In the example shown in FIG. 11, firstly, the first lighting fixture 1*a* is mounted to the wall or the ceiling and then the second lighting fixture 1*b* is mounted to the wall or the ceiling such that the inclined lateral surface 32*b* of the second lighting fixture 1*b* overlaps the inclined lateral surface 32*a* of the first lighting fixture 1*a*. Even if the hole or the adaptor for mounting the second lighting fixture 1*b* is misaligned slightly in the longitudinal direction, the amount of misalignment is absorbed by the gap 52 between the inclined lateral surfaces 32*a* and 32*b* facing each other. That is, the mounting adaptor 40 of the second lighting fixture 1*b* is mounted to, for example, the power adaptor installed in the wall or to the ceiling without interfering with the first lighting fixture 1*a*.

The gap 52 also tolerates expansion and contraction of the cover 30 due to the effect of ambient temperature and moisture in the environment of the mounted lighting fixtures. For example, the cover 30 that has been extended or contracted in the longitudinal direction presses the cover 30 of the adjacent lighting fixture 1, which may cause deformation or break of the adjacent cover 30, and the gap 52 can prevent the deformation or break.

According to the other embodiment, although the gap 52 exists at boundaries of the adjacent lighting fixtures 1, neither the wall surface nor the ceiling surface is exposed from the gap 52. This is due to the overlap of the inclined lateral surfaces 32*a* and 32*b*. One of the inclined lateral surfaces of the adjacent two lighting fixtures 1 (in the case of the example shown in FIG. 11, the inclined lateral surface 32*a* of the first lighting fixture 1*a*) is exposed from the gap 52.

Light is emitted from the light source 22 toward the inclined lateral surfaces 32*a* and 32*b* of the cover 30 and passes through the inclined lateral surfaces 32*a* and 32*b*. The inclined lateral surfaces 32*a* and 32*b* are light-transmissive and also function as emitting surfaces. Hence, the light is extracted outside the lighting fixture 1 from the gap 52 at the boundaries of the adjacent lighting fixtures 1. This configuration prevents dim areas from being generated at the boundaries of the adjacent lighting fixtures 1. The lighting apparatus 100, which has no dim areas at the boundaries of the lighting fixtures 1, also includes the light source 22 having the batwing light distribution characteristic. This configuration provides a large emitting surface with uniform luminance.

According to the other embodiment, a pair of inclined lateral surfaces 32*a* and 32*b* in a single lighting fixture 1 are substantially parallel to each other. The inclined lateral surface 32*a* of a lighting fixture 1 and the inclined lateral surface 32*b* of another lighting fixture 1 adjacent to the lighting fixture 1 face each other and are substantially parallel to each other.

Figure 12:
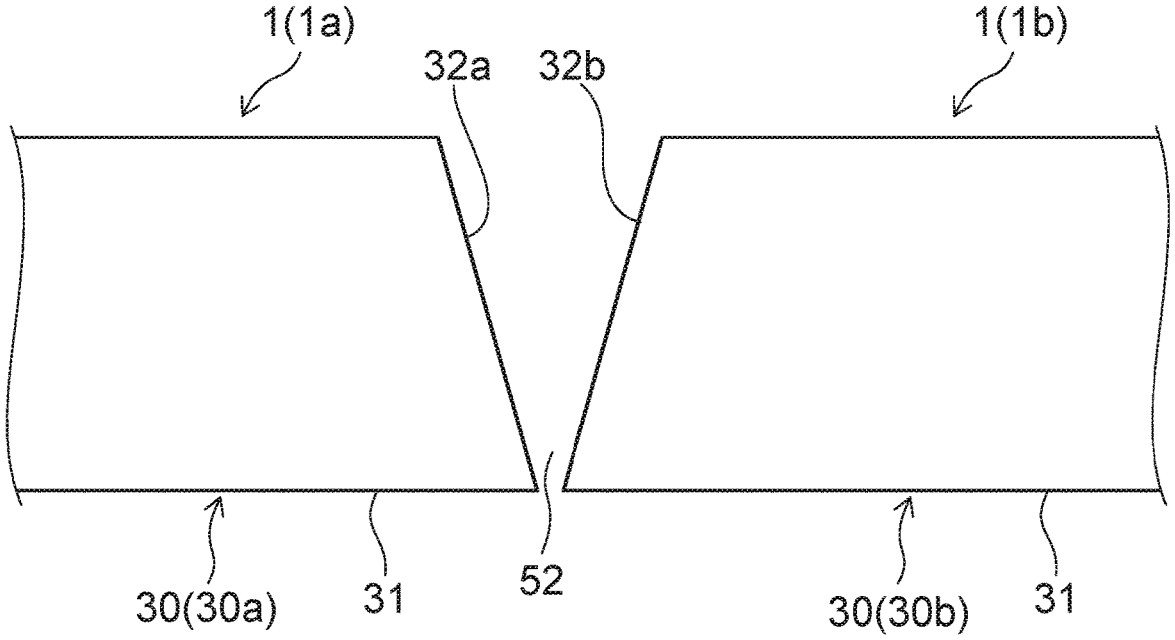
FIG. 12 shows a schematic enlarged view at a boundary portion between covers of adjacent lighting fixtures according to a comparative example.

Here, FIG. 12 is a schematic enlarged view at a boundary portion between covers 30 of adjacent lighting fixtures 1 according to a comparative example.

In the comparative example, a cover 30*a* of a first lighting fixture 1*a* has an inclined lateral surface 32*a* at one end portion and an inclined lateral surface 32*b* at the other end portion, the inclined lateral surface 32*a* and the inclined lateral surface 32*b* being non-parallel to each other. The cover 30*a* has a trapezoidal shape in a side view. Similarly, a cover 30*b* of a second lighting fixture 1*b* has an inclined lateral surface 32*a* at one end portion and an inclined lateral surface 32*b* at the other end portion, the inclined lateral surface 32*a* and the inclined lateral surface 32*b* being non-parallel to each other. The cover 30*b* has a trapezoidal shape in a side view.

Hence, the inclined lateral surface 32*a* of the cover 30*a* of the first lighting fixture 1*a* and the inclined lateral surface 32*b* of the cover 30*b* of the second lighting fixture 1*b* face each other and are non-parallel to each other. The inclined lateral surfaces 32*a* and 32*b* do not overlap when viewed from the main surface 31. This configuration allows the wall surface or the ceiling surface to be seen through the gap 52 from the main surface 31, and dim areas are generated at the boundaries of the adjacent lighting fixtures 1.

By instead having a cover 30 with inclined lateral surface 32*a* at one end portion and an inclined lateral surface 32*b* at the other end portion, which are substantially parallel to each other as shown in FIG. 1, dimness at boundaries between light fixtures is diminished. That is, the inclined lateral surface 32*a* forms an obtuse angle relative to the main surface 31, and the inclined lateral surface 32*b* forms an acute angle relative to the main surface 31. Alternatively, the configuration may be such that the inclined lateral surface 32*a* forms an acute angle relative to the main surface 31, and the inclined lateral surface 32*b* forms an obtuse angle relative to the main surface 31.

A single lighting fixture 1 has, at both end portions, the inclined lateral surfaces 32*a* and 32*b* that are substantially parallel to each other, which means, as shown in FIG. 9, that the inclined lateral surface 32*a* at one end portion of the first lighting fixture 1*a* is disposed substantially in parallel to the inclined lateral surface 32*b* at the other end portion of the second lighting fixture 1*b*. Because these inclined lateral surfaces 32*a* and 32*b* face each other substantially in parallel, the wall or the ceiling is not exposed at the opening of the gap 52 at the main surface 31 but is hidden behind the inclined lateral surface 32*a* or 32*b*.

Here, the term "substantially parallel" is not restricted to being mathematically strictly parallel, and with variation of manufacturing and mounting and the like taken into consideration, also means being virtually parallel such that the inclined lateral surfaces 32*a* and 32*b* face each other and the wall or the ceiling is not seen through the gap 52 between the inclined lateral surfaces 32*a* and 32*b* when viewed from the main surface 31.

In the comparative example shown in FIG. 12, for arraying the inclined lateral surface 32*a* of a lighting fixture 1 parallel to the inclined lateral surface 32*b* of an adjacent lighting fixture 1, a configuration can be considered where a cover 30 in a trapezoidal shape and another cover 30 in an inverted trapezoidal shape are arrayed alternately. In this case, two types of covers 30 with different shapes need to be prepared.

On the contrary, according to the other embodiment, the covers 30 having the same shape can be arrayed adjacently in the longitudinal direction to constitute the lighting apparatus 100, as shown in FIG. 8. Only one type of molding is required in order to mass-produce the cover 30, leading to easy parts control and reduction in manufacturing cost.

Figure 13:
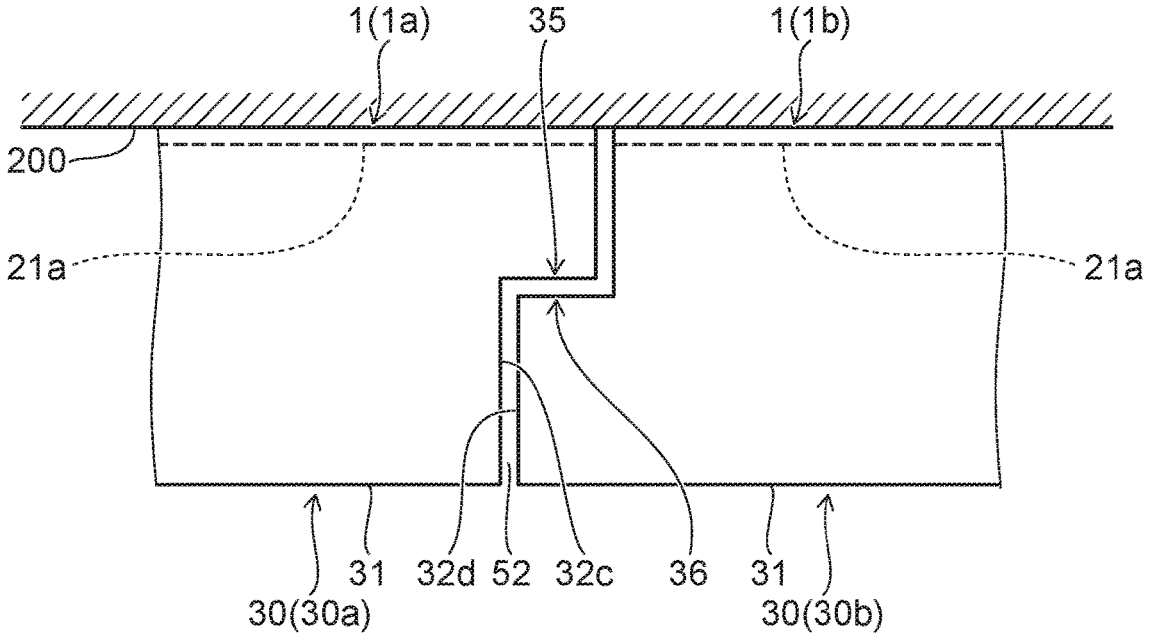
FIG. 13 shows a schematic enlarged view at a boundary portion between a cover of a first lighting fixture and a cover of a second lighting fixture adjacent to the first lighting fixture in a first direction of a lighting apparatus according to another embodiment.

FIG. 13 is a schematic enlarged view at a boundary portion between a cover 30*a* of a first lighting fixture 1*a* and a cover 30*b* of a second lighting fixture 1*b* adjacent to the first lighting fixture 1*a* in a first direction of a lighting apparatus according to another embodiment. The first lighting fixture 1*a* and the second lighting fixture 1*b* shown in FIG. 13 are different from the above embodiment in shape of side surfaces 32*c* and 32*d* of the cover 30. Other elements in the first lighting fixture 1*a* and the second lighting fixture 1*b* shown in FIG. 13 are the same as the above embodiment.

The cover 30*a* of the first lighting fixture 1*a* includes a first side surface 32*c* covering lateral portions of the space 51 (shown in FIG. 5) on a side of the second lighting fixture 1*b*. The cover 30*b* of the second lighting fixture 1*b* includes a second side surface 32*d* covering lateral portions of the space 51 on a side of the first lighting fixture 1*a*. The second side surface 32*d* faces the first side surface 32*c* of the first lighting fixture 1*a* across a gap 52.

The first side surface 32*c* includes a step portion 35 in a direction from the main surface 31 to the light source placement surface 21*a*. The second side surface 32*d* also includes a step portion 36 in the direction from the main surface 31 to the light source placement surface 21*a*. The step portions 35 and 36 face each other across the gap 52. The gap 52 elbows in the direction from the main surface 31 to the light source placement surface 21*a*.

According to this embodiment, the side surfaces 32*c* and 32*d* including the step portions 35 and 36 are adjacent to each other. While making the gap 52 at the boundary between the adjacent lighting fixtures 1*a* and 1*b*, it is possible for a person who looks at the main surface 31 not to see the mounting surface (ceiling surface or wall surface) 200 through the gap 52. Accordingly, the dim area between the adjacent lighting fixtures 1*a* and 1*b* can be suppressed.

The scope of the present invention is not limited to the specific examples illustrated in the Figures. All embodiments that can be made through appropriate design changes made by a person skilled in the art on the basis of the above-described embodiment of the present invention are within the scope of the present invention as long as the embodiments involve the gist of the present invention. In addition, a person skilled in the art may consider various variations and modifications within the idea of the present invention. Therefore, those variations and modifications are also within the scope of the present invention.

The invention claimed is:

1. A lighting fixture comprising:
a light source module comprising:
a base having a surface having a first lateral edge and a second lateral edge, and
a plurality of light sources disposed on the surface of the base; and
a light-transmissive cover disposed over the light source module, the light-transmissive cover comprising:
a main surface separated from the surface of the base, the main surface terminating at a third lateral edge and a fourth lateral edge,
a first side surface extending from the third lateral edge towards the first lateral edge of the base, and
a second side surface extending from the fourth lateral edge towards the second lateral edge of the base,
wherein,
the first lateral edge is laterally offset by a first distance from a first orthogonal reference plane with respect to the third lateral edge,
the second lateral edge is laterally offset by a second distance from a second orthogonal reference plane with respect to the fourth lateral edge, and
the main surface, the first side surface, and the second side surface comprise a light-transmissive material configured to transmit light emitted by the plurality of light sources.

2. The lighting fixture according to claim 1, wherein the first side surface is substantially parallel to the second side surface.

3. The lighting fixture according to claim 1, wherein each light source of the plurality of light sources is characterized by a batwing light distribution.

4. The lighting fixture according to claim 1, wherein
the first side surface comprises a first planar surface disposed at an incline with respect to the first orthogonal reference plane, and
the second side surface comprises a second planar surface disposed at an incline with respect to the second orthogonal reference plane.

5. The lighting fixture according to claim 4, wherein
the first planar surface forms an obtuse angle relative to the main surface; and
the second planar surface forms an acute angle relative to the main surface.

6. The lighting fixture according to claim 4, wherein the first planar surface is parallel to the second planar surface.

7. The lighting fixture according to claim 1, wherein
the first side surface comprises a first step surface disposed between the first lateral edge of the base and the third lateral edge of the main surface, and
the second side surface comprises a second step surface disposed between the second lateral edge of the base and the fourth edge of the main surface.

8. The lighting fixture according to claim 1, wherein the first side surface comprises a first curved surface disposed between the first lateral edge of the base and the third lateral edge of the main surface, and the second side surface comprises a second curved surface disposed between the second lateral edge of the base and the fourth edge of the main surface.

9. The lighting fixture according to claim 1, wherein the first side surface and the second side surface have a same shape.

10. The lighting fixture according to claim 1, wherein the main surface has a rectangular shape.

11. A lighting fixture system comprising at least two light fixtures each according to claim 1, the system comprising:

a first lighting fixture according to claim 1 configured to be mounted laterally adjacent to a second lighting fixture according to claim 1 relative to the first side surface of the first lighting fixture, wherein, the first side surface of the first lighting fixture faces the second side surface of the second lighting fixture and is separated from the second side surface of the second lighting fixture by a third distance, and the third distance is less than the first distance.

12. The lighting fixture system, according to claim 11, comprising a third lighting fixture according to claim 1 configured to be mounted laterally adjacent to the first lighting fixture relative to the second side surface of the first lighting fixture, wherein, the first side surface of the third lighting fixture faces the second side surface of the first lighting fixture and is separated from the second side surface of the second lighting fixture by a fourth distance, and the fourth distance is less than the second distance.

13. The lighting fixture system according to claim 11, wherein the first side surface of the first lighting fixture is substantially parallel to the second side surface of the second lighting fixture.

14. The lighting fixture system according to claim 12, wherein the first side surface of the third lighting fixture is substantially parallel to the second side surface of the first lighting fixture.

15. The lighting fixture system according to claim 11, wherein the first side surface of the first lighting fixture and the second side surface of the second lighting fixture have a same shape.

16. The lighting fixture system according to claim 15, wherein the same shape is a planar shape, a step shape, or a curved shape.

17. The lighting fixture system according to claim 12, wherein the first side surface of the first lighting fixture, the second side surface of the first lighting fixture, the second side surface of the second lighting fixture, and the first side surface of the third lighting fixture have a same shape.

18. The lighting fixture system according to claim 17, wherein the same shape is a planar shape, a step shape, or a curved shape.

19. The lighting fixture system according to claim 11, wherein each light source of the plurality of light sources of the first lighting fixture and the second lighting fixture is characterized by a batwing light distribution.

20. The lighting fixture system according to claim 11, wherein the main surface of the first lighting apparatus and the main surface of the second lighting apparatus each has a rectangular shape.

21. The lighting fixture according to claim 1, further comprising:

a mounting adaptor disposed on a backside of the surface of the base at an interior position relative to the first lateral edge and second the second lateral edge.

* * * * *